US009409402B2

(12) United States Patent
Shinkai

(10) Patent No.: US 9,409,402 B2
(45) Date of Patent: Aug. 9, 2016

(54) LIQUID FILLING METHOD, LIQUID FILLING DEVICE, AND LIQUID CONTAINER

(71) Applicant: SEIKO EPSON CORPORATION, Tokyo (JP)

(72) Inventor: Katsumi Shinkai, Fujimi-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 242 days.

(21) Appl. No.: 14/184,102

(22) Filed: Feb. 19, 2014

(65) Prior Publication Data

US 2014/0238944 A1 Aug. 28, 2014

(30) Foreign Application Priority Data

Feb. 28, 2013 (JP) ..... 2013-038465

(51) Int. Cl.
*B65B 37/00* (2006.01)
*B41J 2/175* (2006.01)

(52) U.S. Cl.
CPC ..... *B41J 2/175* (2013.01); *B41J 2/17509* (2013.01); *B41J 2/17563* (2013.01); *B41J 2002/17516* (2013.01)

(58) Field of Classification Search
CPC ..... B01D 29/885; B41J 2/17563; B41J 2002/17516
USPC ..... 141/244, 248, 286; 347/85, 86; 210/806, 418
See application file for complete search history.

(56) References Cited

U.S. PATENT DOCUMENTS 5,352,371 A * 10/1994 Felt ..... A61M 1/0209 210/252
7,934,816 B2 5/2011 Tsukahara et al.

FOREIGN PATENT DOCUMENTS

| | | |
|---|---|---|
| JP | A-11-342634 | 12/1999 |
| JP | A-2002-52731 | 2/2002 |
| JP | A-2002-254675 | 9/2002 |
| JP | A-2005-186343 | 7/2005 |

* cited by examiner

*Primary Examiner* — Jason K Niesz
(74) *Attorney, Agent, or Firm* — Oliff PLC

(57) ABSTRACT

A liquid filling device includes a supply tube, a filter capable of removing a foreign matter, a first on-off valve provided between the supply tube and the filter, a first connector provided between the first on-off valve and the filter, a second on-off valve provided downstream of the filter, a second connector connected to the second on-off valve. A first ink pack and a second ink pack are respectively connected to the first connector and the second connector. After the liquid is filled in the first ink pack, the liquid thus filled is transferred from the first ink pack to the second ink pack connected to the second connector through the filter.

12 Claims, 7 Drawing Sheets

LIQUID FILLING METHOD, LIQUID FILLING DEVICE, AND LIQUID CONTAINER

BACKGROUND

1. Technical Field

The present invention relates to a method and a device for filling a container with a liquid maintaining the cleanness of the liquid, and to a liquid container.

2. Related Art

For example, JP-A-2005-186343 discloses a method of filling a liquid chamber unit with a liquid, the liquid chamber unit including a liquid chamber capable of containing a liquid therein and a communication port that secures communication between inside and outside of the liquid chamber. The method includes aspirating air from inside of the liquid chamber through the communication port by using a first suction unit, introducing, by using a liquid injector, the liquid stored in a liquid storage unit into the liquid chamber as cleaning liquid through the communication port, aspirating the cleaning liquid introduced into the liquid chamber through the communication port by using a second suction unit, mixing the cleaning liquid aspirated by the second suction unit and the liquid in the liquid storage unit by using a mixer, and introducing the liquid mixed by the mixer into the liquid chamber by using the liquid injector.

By the liquid filling method according to JP-A-2005-186343, the liquid supplied from the liquid storage unit is introduced into the liquid chamber depressurized by the first suction unit, and the liquid thus introduced is aspirated by using the second suction unit, in the manufacturing process of the liquid chamber unit. Accordingly, dust and air in the liquid chamber and the communication port are discharged together with the liquid. Then the liquid aspirated by the second suction unit is mixed with the liquid in the liquid storage unit by the mixer and introduced into the liquid chamber by the liquid injector, and therefore the aspirated liquid can be utilized as the liquid to be stored in the liquid chamber unit, without being disposed of. Such an arrangement improves the degree of deaeration and cleanness in the liquid chamber unit, and allows the liquid to be efficiently utilized in the manufacturing process of the liquid chamber unit.

To perform the liquid filling method according to JP-A-2005-186343, however, the cleanness of the first and the second suction unit and the liquid injector, through which the liquid passes, has to be secured in advance. The liquid to be actually filled may be employed as the cleaning liquid in order to secure the cleanness in advance, however the liquid used for cleaning is not always reusable. For example, in the case where the cleaning liquid contains an ionic impurity, the liquid may be non-reusable depending on the purpose of use of the liquid. Further, the complicated structure of the liquid filling device often brings about loss of the liquid in the aspirating process and the filling process. Therefore, especially when an expensive liquid is to be filled in the liquid chamber unit, the loss of the liquid has to be minimized as much as possible.

SUMMARY

Accordingly, the invention may be advantageously realized as the following application examples and embodiments.

Application Example 1

A first example represents a method of filling a sealable liquid container with a liquid. The method includes performing a first filling of a first liquid container with the liquid, transferring the liquid filled in the first liquid container to a second liquid container through a filter at least capable of removing a foreign matter, exchanging the second liquid container located downstream of the filter with the first liquid container, and performing a second filling of the first liquid container with the liquid through the filter.

By the mentioned method, the liquid filled in the first liquid container is transferred to the second liquid container. Therefore, the foreign matter existing in the first liquid container is discharged together with the liquid and then removed by the filter. In other words, the internal area of the first liquid container is cleaned with the liquid. Thereafter the second filling step follows in which the liquid is again filled in the first liquid container through the filter. Such an arrangement allows the liquid to be filled in the first liquid container, with sufficient cleanness secured inside the first liquid container.

In addition, the supply path for supplying the liquid therethrough is also cleaned with the liquid, through the first filling step and the transfer step. In case that the second liquid container, filled with the liquid transferred from the first liquid container through the filter, is suspected to contain an ionic impurity other than the foreign matter, the second liquid container may be disposed of. Thus, repeating the steps according to the foregoing liquid filling method enables the liquid to be filled in the liquid container constantly maintaining the cleanness inside the liquid container.

Application Example 2

In the foregoing liquid filling method, the second filling step may include connecting the second liquid container to the upstream end of the filter, connecting the first liquid container to the downstream end of the filter, and transferring the liquid transferred to the second liquid container to the first liquid container through the filter.

In this case, the liquid from which the foreign matter has been removed can be filled in the first liquid container cleaned through the first filling step and the transfer step, and the internal area of the second liquid container can be cleaned with the liquid, by transferring the liquid from the second liquid container to the first liquid container in the second filling step. Accordingly, the second liquid container filled with the liquid is exempted from being disposed of, and therefore loss of the liquid can be reduced in the liquid filling process.

Application Example 3

A third example represents another method of filling a sealable liquid container with a liquid. The method includes connecting a first liquid container and a second liquid container in parallel on a downstream side of a filter at least capable of removing a foreign matter, performing a first filling of the first liquid container with the liquid through the filter, transferring the liquid to the second liquid container through the filter after returning the liquid in the first liquid container to the upstream side of the filter, performing a second filling of the first liquid container with the liquid through the filter after returning the liquid transferred to the second liquid container to the upstream side of the filter, and performing a third filling of the second liquid container with the liquid after the second filling.

The foregoing method allows the internal area of the first liquid container to be cleaned with the liquid, through the first filling step and the transfer step. Then through the second filling step the liquid can be again filled in the first liquid container that has been cleaned, and the internal area of the second liquid container can be cleaned with the liquid. Further, through the third filling step the liquid can be filled in the second liquid container that has been cleaned. Thus, the foregoing liquid filling method eliminates, unlike the method according to the application example 1, the need to exchange the second liquid container with the first liquid container, and allows the liquid to be filled in the liquid container with sufficient cleanness secured.

Application Example 4

In the liquid filling method arranged as above, the first liquid container and the second liquid container, both serving as the liquid container, may each include a flexible liquid bag for storing the liquid therein and a communication port that secures communication between inside and outside of the liquid bag. To transfer the liquid filled in the first liquid container or the second liquid container, a pressure may be applied to the liquid bag from outside so as to discharge the liquid from the liquid bag through the communication port.

By the foregoing method, the liquid is discharged by the pressure applied to the liquid bag from outside. Therefore, unlike the method according to JP-A-2005-186343 in which a suction unit is employed to discharge the liquid, the liquid is exempted from the risk of contamination by the suction unit. Further, not only the liquid bag but also the communication port can be cleaned at a time.

Application Example 5

A fifth application example represents a liquid filling device that fills a sealable liquid container with a liquid. The liquid filling device includes a supply path of the liquid, a filter connected to the supply path and at least capable of removing a foreign matter, a first on-off valve provided between the supply path and the filter, a first connector provided between the first on-off valve and the filter, a second on-off valve provided between the first connector and the filter, or downstream of the filter, a second connector provided downstream of the filter via the second on-off valve therebetween, and a first liquid container and a second liquid container respectively connected to the first connector and the second connector. The first liquid container connected to the first connector is filled with the liquid through the supply path and the first on-off valve, and the liquid thus filled is transferred to the second liquid container connected to the second connector through the second on-off valve and the filter.

In the foregoing liquid filling device, the liquid filled in the first liquid container connected to the first connector is transferred through the filter to the second liquid container connected to the second connector, and therefore the first liquid container connected to the first connector can be cleaned with the liquid. Then the first liquid container can be filled with the liquid with sufficient cleanness secured, by connecting the first liquid container that has been cleaned to the second connector and filling the first liquid container with the liquid through the filter. Therefore, the liquid filling device thus configured allows the liquid container to be filled with the liquid with sufficient cleanness secured.

Application Example 6

In the foregoing liquid filling device, the first and the second liquid container respectively connected to the first and the second connector may be exchanged after the liquid is transferred, and the liquid may be again transferred from the first liquid container filled with the liquid to the second liquid container not yet filled with the liquid, through the filter.

In this case, both the first and the second liquid container, respectively connected to the first and the second connector, can be cleaned with the liquid.

Application Example 7

A seventh application example represents another liquid filling device that fills a sealable liquid container with a liquid. The liquid filling device includes a supply path of the liquid, a filter connected to the supply path and at least capable of removing a foreign matter, a first on-off valve provided downstream of the filter, a first connector connected to the first on-off valve, a second on-off valve provided downstream of the filter parallel to the first on-off valve, a second connector connected to the second on-off valve, a first bypass route provided between the supply path upstream of the filter and the first connector, a third on-off valve provided on the first bypass route, a second bypass route provided between the supply path upstream of the filter and the second connector, and a fourth on-off valve provided on the second bypass route. A first liquid container and a second liquid container are respectively connected to the first connector and the second connector. The liquid is filled in the first liquid container connected to the first connector through the supply path, the filter, and the first on-off valve, with the second on-off valve, the third on-off valve, and the fourth on-off valve closed, and then the first on-off valve is closed and the liquid filled in the first liquid container is transferred to the second liquid container connected to the second connector through the first bypass route, the filter, and the second on-off valve. Then the second on-off valve is closed and the liquid transferred to the second liquid container is again transferred to the first liquid container connected to the first container through the second bypass route, the filter, and the first on-off valve.

In the foregoing liquid filling device, providing the first bypass route and the second bypass route enables the first and the second liquid container, respectively connected to the first and the second connector, to be cleaned with the liquid without the need to exchange the first liquid container and the second liquid container. Such a configuration eliminates the need to exchange the liquid containers and allows each of the liquid containers to be cleaned before being filled with the liquid.

Application Example 8

In the foregoing liquid filling device, the first on-off valve, the third on-off valve, and the fourth on-off valve may be closed and the second on-off valve may be opened, so as to again fill the second liquid container connected to the second connector through the supply path and the filter, after the liquid is again transferred to the first liquid container connected to the first connector.

Such a configuration allows the second liquid container, connected to the second connector and now cleaned, to be filled with the liquid from which foreign matters have been removed.

Application Example 9

In the foregoing liquid filling device, the liquid container may include a flexible liquid bag for storing the liquid therein, and a communication port that secures communication between inside and outside of the liquid bag. The liquid filling device further includes a pressurizing device that applies a pressure to the liquid bag from outside so as to discharge the liquid from the liquid bag through the communication port.

Such a configuration allows the liquid to be discharged by the pressure applied by the pressurizing device to the liquid bag from outside. Therefore, unlike the arrangement according to JP-A-2005-186343 in which a suction unit is employed to discharge the liquid, the liquid is exempted from the risk of contamination by the suction unit. Further, not only the liquid bag but also the communication port can be cleaned at a time.

Application Example 10

In the foregoing liquid filling device, preferably, the filter may be configured so as to discharge an air bubble in the liquid.

Such a configuration allows the liquid container to be filled with the liquid from which foreign matters and air bubbles have been removed.

Application Example 11

An eleventh application example represents a liquid container configured to be filled with a liquid by the liquid filling method according to the foregoing application examples.

Application Example 12

A twelfth application example represents a liquid container configured to be filled with a liquid by the liquid filling device according to the foregoing application examples.

The liquid container thus configured can have the internal area cleaned, and be filled with a liquid from which foreign matters have been removed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
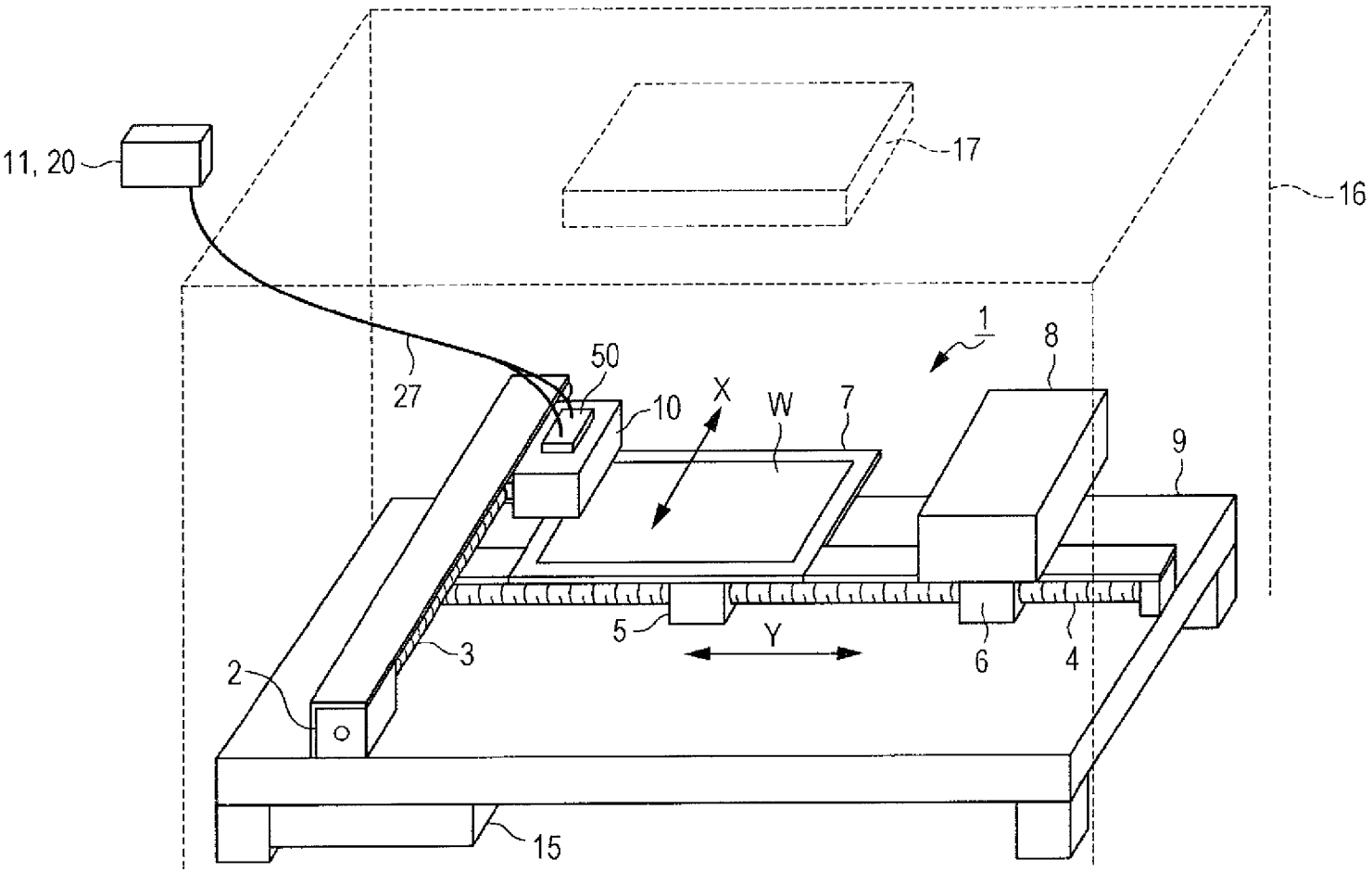
FIG. 1 is a schematic perspective view showing a configuration of a dispensing device.

Hereafter, embodiments of the invention will be described referring to the drawings. For the sake of better visual recognition, components shown in the drawings may be enlarged or minified as the case may be.

The embodiments represent a liquid container that stores therein a functional liquid containing a functional material (hereinafter, liquid or ink) and a liquid filling device that fills the liquid container with the functional liquid, to be used in a dispensing device that dispenses the functional liquid onto a workpiece to thereby form a functional film containing the functional material on the workpiece.

First Embodiment

Dispensing Device

Figure 2:
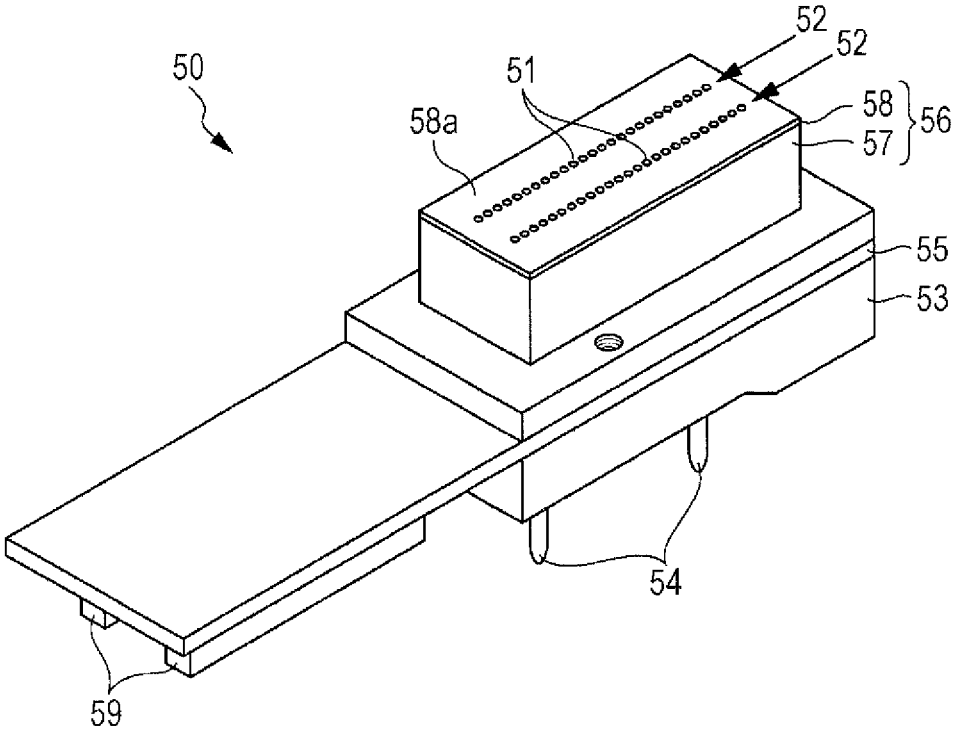
FIG. 2 is a schematic perspective view showing a configuration of a dispensing head.
Figure 3:
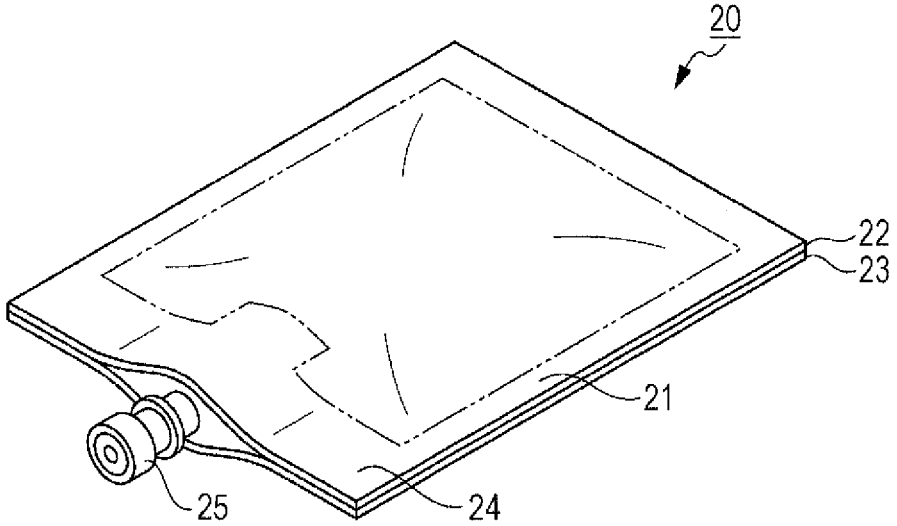
FIG. 3 is a schematic perspective view showing a configuration of an ink pack serving as a liquid container.

Referring first to FIGS. 1 to 3, the dispensing device and the liquid container will be described. FIG. 1 is a schematic perspective view showing a configuration of the dispensing device, FIG. 2 is a schematic perspective view showing a configuration of a dispensing head, and FIG. 3 is a schematic perspective view showing a configuration of an ink pack serving as the liquid container.

As shown in FIG. 1, the dispensing device 1 includes a stage 7 on which a substrate W exemplifying the workpiece is to be placed, and a dispensing head 50 that dispenses a functional liquid in the form of liquid droplets onto the substrate W placed on the stage 7. The functional liquid is supplied to the dispensing head 50 from an ink cartridge 11 including therein an ink pack 20 (see FIG. 3), exemplifying the liquid container, filled with the functional liquid, through a tube 27.

The dispensing device 1 includes an x-direction guide shaft 3 for driving a carriage 10 on which the dispensing head 50 is mounted in a sub scanning direction (X-direction), an X-axis driving motor 2 that rotates the X-direction guide shaft 3, a Y-direction guide shaft 4 for driving the stage 7 in a main scanning direction (Y-direction) orthogonal to the sub scanning direction (X-direction), and a Y-axis driving motor 5 that rotates the Y-direction guide shaft 4. The dispensing device 1 also includes a base table 9 on which the X-direction guide shaft 3 and the Y-direction guide shaft 4 are mounted, and a control unit 15 provided under the base table 9. The X-direction guide shaft 3, the X-axis driving motor 2, the Y-direction guide shaft 4 and the Y-axis driving motor 5 constitute a moving mechanism that relatively moves the stage 7 in the main scanning direction (Y-direction) and the sub scanning direction (X-direction) with respect to the dispensing head 50, with the stage 7 disposed so as to oppose the dispensing head 50.

Further, the dispensing device 1 includes a cleaning mechanism 8 that cleans (restores) the dispensing head 50. The cleaning mechanism 8 also includes a Y-axis driving motor 6.

The dispensing head 50 is mounted on the carriage 10 such that a nozzle surface 58*a* (see FIG. 2) is opposed to the stage 7. The dispensing head 50 is configured to vary the amount of the droplet of the functional liquid to be dispensed therefrom (dispensing amount) according to a voltage supplied by the control unit 15.

The X-axis driving motor 2 may be, for example, a stepping motor that rotates the X-direction guide shaft 3 upon receipt of an X-direction driving pulse signal from the control unit 15, to thereby move the dispensing head 50 engaged with the X-direction guide shaft 3 in the X-direction.

Likewise, the Y-axis driving motors 5, 6 may each be, for example, a stepping motor that rotates the Y-direction guide shaft 4 upon receipt of a Y-direction driving pulse signal from the control unit 15, to thereby move the stage 7 and the cleaning mechanism 8 in the Y-direction.

The cleaning mechanism 8 is moved to a position close to the dispensing head 50, and serves to aspirate an excess of the functional liquid in close contact with the nozzle surface 58*a* (in FIG. 2) of the dispensing head 50 (capping), wipe the nozzle surface 58*a* to which the functional liquid is stuck (wiping), dispense the functional liquid through all nozzles 51 of the dispensing head 50 (preliminary dispensation), and receive residual functional liquid to discharge the same (restoration).

The entirety of the dispensing device 1 is enclosed in a clean booth 16. Cleaned air is introduced into the clean booth 16 through a HEPA unit 17 located on the ceiling of the clean booth 16. Accordingly, cleanness is secured inside the clean booth 16, to keep a foreign matter from sticking to the surface of the substrate W before the functional liquid is dispensed onto the surface of the substrate W.

As shown in FIG. 2, the dispensing head 50 is of a dual type including an introduction chamber 53 of the functional liquid having a pair of connection needles 54, a head substrate 55 stacked on the introduction chamber 53, and a head main body 56 mounted on the head substrate 55 and including an in-head flow path for the functional liquid. The connection needles 54 are each connected to the ink cartridge 11 through the tube 27, so that the functional liquid is introduced into the in-head flow path through the connection needles 54. The head substrate 55 includes a pair of connectors 59 connected to a head driving circuit through a flexible flat cable.

The head main body 56 includes a pressure unit 57 having a cavity in which an actuator such as a piezoelectric element is provided, and a nozzle plate 58 including a pair of nozzle rows 52, 52 formed in parallel on the nozzle surface 58*a*.

The nozzle rows 52, 52 each include a plurality (in this embodiment, 180) of nozzles 51 aligned on the nozzle plate 58 at generally regular intervals, such that the nozzles on one of the rows are shifted by half a pitch from the nozzles of the other row. The nozzle pitch in this embodiment is approximately 140 μm. Accordingly, 360 nozzles 51 are aligned at intervals of approximately 70 μm, when viewed in the direction orthogonal to the nozzle rows 52.

In the dispensing head 50, an electrical signal representing a driving waveform applied to the actuator from the head driving circuit causes a change in volume of the cavities respectively associated with the nozzles 51 of the pressure unit 57, so that a pressure is applied owing to a pumping effect to the functional liquid filled in the cavity, and thus the functional liquid is dispensed through the nozzle 51 communicating with the cavity, in the form of a droplet.

The dispensing head 50 may be what is known as an ink jet head, and the actuator may be, without limitation to the piezoelectric element, an electrothermal converter such as a heater that heats the functional liquid so as to be dispensed through the nozzle 51, or an electromechanical converter that electrostatically deforms a vibrating plate constituting the cavity.

Liquid Container

As shown in FIG. 3, the ink pack 20 exemplifying the liquid container in the invention includes a liquid bag 21 and a communication port 25 for communication between inside and outside of the liquid bag 21. The liquid bag 21 is composed of two flexible rectangular films 22, 23 of the same size superposed on each other, and formed into a bag shape by thermal bonding of the periphery of the four sides. In addition, the communication port 25 is interposed between the films 22, 23 on one of the sides 24 of the liquid bag 21. Accordingly, the internal space of the liquid bag 21 is sealed, to be filled with the functional liquid.

The films 22, 23 have a multilayer structure composed of thermoplastic resin layers, such as polyethylene, and a gas barrier layer such as aluminum vapor-deposited between the resin layers. The communication port 25 is formed of a resin that can be thermally bonded with the thermoplastic resin layers of the films 22, 23. Thus, the functional liquid is introduced into the liquid bag 21 through the communication port 25. Upon closing the communication port 25, the ink pack 20 filled with the functional liquid can be tightly sealed. The capacity of the ink pack 20 serving as the liquid container is, for example, 500 ml.

The ink pack 20 is filled with the functional liquid by using the liquid filling device to be subsequently described, and therefore the functional liquid can be retained in the ink pack 20 in which cleanness is secured free from foreign matters. Accordingly, upon dispensing the functional liquid in the ink pack 20 thus prepared onto the substrate W through the dispensing head 50 of the dispensing device 1, the functional film free from foreign matters can be stably formed on the substrate W. Here, the foreign matters to be removed in this embodiment include those intruding from the working environment such as metal powder and fibers, and a part of the functional liquid that has turned into gel.

Further, a plurality of dispensing heads 50 may be mounted on the carriage 10 of the dispensing device 1 instead of one, according to the type of the functional liquid to be dispensed. In this case, the same number of ink cartridges 11, each including the ink pack 20, as that of the types of the functional liquid are to be provided.

An example of the functional liquid (ink) to be filled in the ink pack 20 is one that contains a material that forms a light emitting layer, employed for forming a light emitting layer of an organic electroluminescence (EL) element through a liquid-phase process. The material for forming a light emitting layer contains a low- or high-molecular organic semiconductor material, and the functional liquid contains a material that disperses or dissolves the semiconductor material, for example an organic solvent. It is essential that such a functional liquid be free from foreign matters and ionic impurities, in order to secure a desired emission characteristic and life span of the light emitting layer.

Here, the organic EL element is composed of an anode, a cathode, and a functional layer including the light emitting layer interposed between the anode and the cathode. The functional layer includes, in addition to the light emitting layer, thin-film layers such as a hole injection layer, a hole transport layer, an electron transport layer, and an electron injection layer. These thin-film layers can also be formed through a liquid-phase process. Therefore, for example a functional liquid containing a material for forming the hole injection layer, or a functional liquid containing a material for forming the hole transport layer may be involved in the filling and dispensing process. The manufacturing process of such functional liquids themselves is performed in an environment where, for example, the cleanness corresponding to Class 10 to 100 is secured.

Liquid Filling Device

Figure 4:
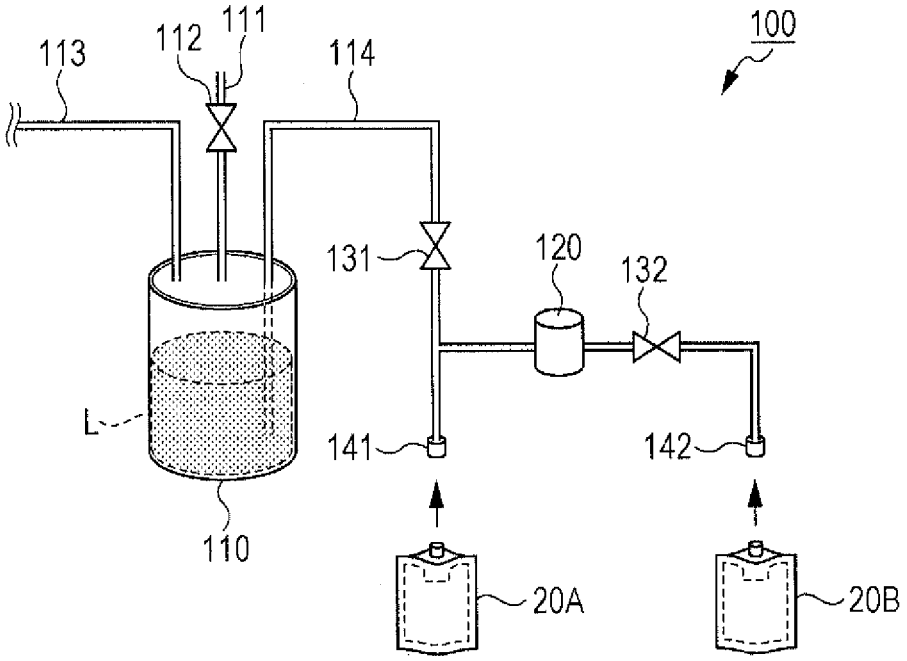
FIG. 4 is a schematic drawing showing a configuration of a liquid filling device according to a first embodiment.
Figure 5:
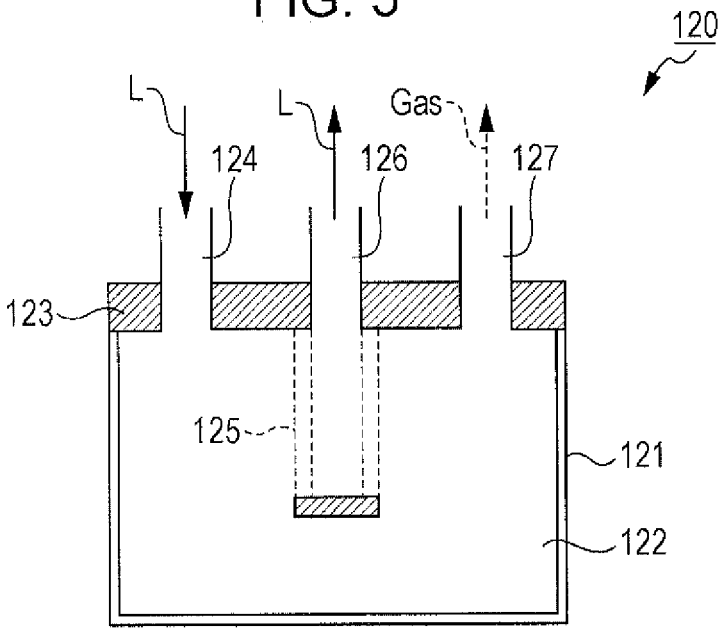
FIG. 5 is a schematic cross-sectional view showing a configuration of a filter.
Figure 6:
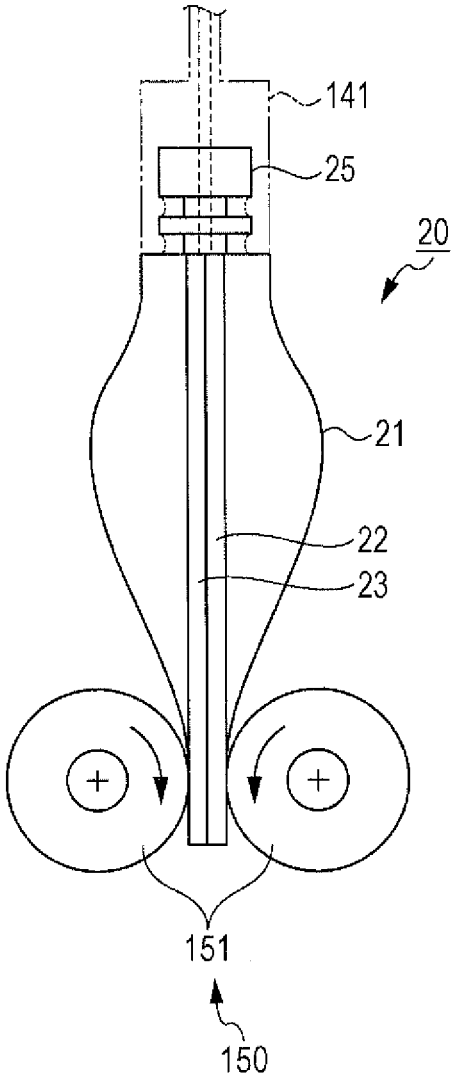
FIG. 6 is a schematic drawing showing a configuration of a pressurizing device for the ink pack.

Referring now to FIGS. 4 to 6, the liquid filling device according to this embodiment will be described hereunder. FIG. 4 is a schematic drawing showing a configuration of the liquid filling device according to the first embodiment, FIG. 5 is a schematic cross-sectional view showing a configuration of a filter, and FIG. 6 is a schematic drawing showing a configuration of a pressurizing device for the ink pack.

As shown in FIG. 4, the liquid filling device 100 according to this embodiment includes an ink tank 110 to store therein the functional liquid L, and a first connector 141 and a second connector 142 both connected to a filter 120 and respectively connected to the ink packs 20 (20A, 20B).

The ink tank 110 is a sealed tank, and an inlet tube 111 and an inlet valve 112 for the functional liquid L are provided above the ink tank 110. In addition, a gas inlet tube 113 is provided above the ink tank 110 for introducing a gas for pressurizing the inside of the ink tank 110. A supply tube 114, exemplifying the supply path in the invention, is connected to the ink tank 110, and an end portion of the supply tube 114 extends as far as the vicinity of the inner bottom of the ink tank 110. The other end portion of the supply tube 114 is connected to the first connector 141 and the filter 120. The second connector 142 is located downstream of the filter 120. A first on-off valve 131 is provided in a portion of the supply tube 114 upstream of the filter 120. A second on-off valve 132 is provided between the filter 120 and the second connector 142. Alternatively, the second on-off valve 132 may be located upstream of the filter 120 at a position close thereto. Further, in the case where the liquid filling device 100 is configured so as to change the flowing direction of the functional liquid L, a three-way on-off valve having the functions of both the first on-off valve 131 and the second on-off valve 132 may be employed.

The liquid filling device 100 is configured to supply the functional liquid L to the first connector 141 and the filter 120 through the supply tube 114, by pressurizing the ink tank 110 filled with the functional liquid L with an inert gas such as nitrogen through the gas inlet tube 113.

As shown in FIG. 5, the filter 120 is of a capsule type and includes a cylindrical casing 121 and an upper lid 123 that covers the casing 121. A bottomed cylindrical filter element 125 is attached to the upper lid 123 at a generally central position thereof. The upper lid 123 includes a liquid inlet 124 communicating with the internal space 122 of the casing 121, a liquid outlet 126 communicating with the filter element 125, and a gas discharge port 127 communicating with the internal space 122 of the casing 121, and through which a gas is discharged as shown in FIG. 5.

In the filter 120, the filter element 125 removes foreign matters from the liquid introduced into the internal space 122 through the liquid inlet 124, and the liquid is discharged through the liquid outlet 126. At the same time, the gas contained in the liquid is released through the gas discharge port 127. Thus, the filter 120 is capable of removing foreign matters, as well as separating a gas in the liquid and discharging the gas.

The filter element 125 is a mesh filter formed of a fluorine-based resin such as tetrafluoroethylene perfluoroalkylvinylether copolymer (PFA) or polytetrafluoroethylene (PTFE), polypropylene (PP), polyethylene (PE), or the like. The mesh size may be in a range of 0.1 μm to 0.2 μm, and may be selected according to the size of the foreign matter to be removed.

As shown in FIG. 6, the liquid filling device 100 includes a pressurizing device 150 that applies a pressure to the ink pack 20 connected to the first connector 141.

The pressurizing device 150 includes a pair of pressure rollers 151 opposed to each other with a predetermined gap therebetween. The pressurizing device 150 is configured to hold the end portion of the liquid bag 21 opposite to the communication port 25 between the pressure rollers 151, and to sequentially pressurize the liquid bag 21 toward the communication port 25 by rotating the pressure roller 151, thus to discharge the functional liquid L in the ink pack 20 through the communication port 25.

Without limitation to the above, the pressurizing device 150 may include a support member that supports one of the sides of the liquid bag 21 of the ink pack 20, and a pressing member that presses the liquid bag 21 held between the support member and the pressing member. Alternatively, the pressurizing device 150 may include a sealed container in which the liquid bag 21 can be accommodated and a pressure unit that supplies a fluid (liquid or gas) into the sealed container.

In place of the pressurizing device 150, further, a pressure difference mechanism may be provided that makes a pressure difference between the ink pack 20A and the ink pack 20B so as to transfer the functional liquid L filled in the ink pack 20A to the ink pack 20B by means of the pressure difference.

In addition to the configuration shown in FIG. 4, the liquid filling device 100 may include a meter that monitors the amount and density of the functional liquid L in the ink tank 110, a heating device such as a heater for lowering the viscosity of the functional liquid L, a meter that detects the pressure at the front and rear of the filter 120 to thereby monitor the life span of the filter 120 on the basis of the pressure difference (pressure loss), a meter that monitors the size and amount of particles (foreign matters) contained in the functional liquid L, or a degassing module that removes a gas dissolved in the functional liquid L.

Liquid Filling Method

Figure 7A:
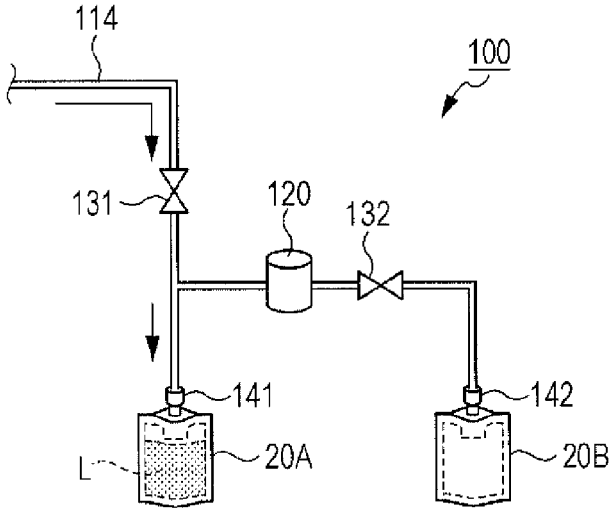
FIGS. 7A to 7C are schematic drawings for explaining a liquid filling method according to the first embodiment.
Figure 7B:
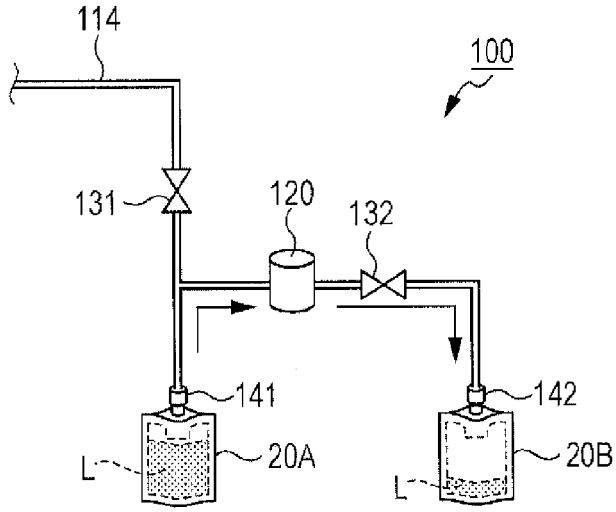
Figure 7C:
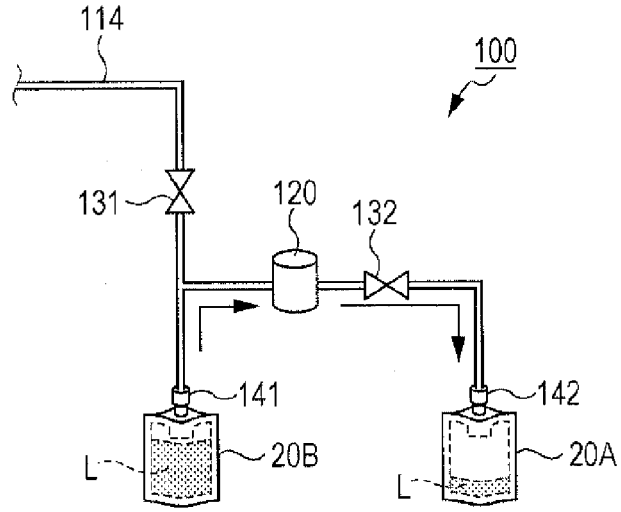

Referring now to FIGS. 7A to 7C, a liquid filling method performed by using the liquid filling device 100 will be described hereunder. FIGS. 7A to 7C are schematic drawings for explaining the liquid filling method according to the first embodiment. The ink tank 110 and the pressurizing device 150 are excluded from FIGS. 7A to 7C for the sake of clarity.

The method of filling the ink pack 20, corresponding to the liquid container in the invention, with the functional liquid L by using the liquid filling device 100 according to this embodiment includes a connection step, a first filling step, a transfer step, and a second filling step.

In the connection step, the ink packs 20A and 20B, which are empty at this point, are respectively connected to the first connector 141 and the second connector 142. The ink pack 20A connected to the first connector 141 corresponds to the first liquid container in the invention, and the ink pack 20B connected to the second connector 142 corresponds to the second liquid container in the invention. Here, gas (air) in the empty ink packs 20A, 20B is discharged by pressurizing the liquid bag 21, before these ink packs are connected to the first connector 141 and the second connector 142.

In the first filling step, the functional liquid L is introduced into the ink pack 20A connected to the first connector 141 through the supply tube 114 as shown in FIG. 7A, with the first on-off valve 131 opened and the second on-off valve 132 closed. As already stated, the functional liquid L can be introduced into the ink pack 20A through the supply tube 114 by pressurizing the inside of the ink tank 110 in which the functional liquid L is stored.

In the transfer step, the pressurizing device 150 applies a pressure to the ink pack 20A now filled with the functional liquid L, with the first on-off valve 131 closed and the second on-off valve 132 opened. Accordingly, the functional liquid L in the ink pack 20A is transferred to the ink pack 20B connected to the second connector 142 through the filter 120 and the second on-off valve 132, as shown in FIG. 7B. By discharging the functional liquid L from the ink pack 20A at the transfer step, foreign matters in the ink pack 20A, if any, are discharged together with the functional liquid L and then removed by the filter 120. Thus, the inside of the ink pack 20A and the communication port 25 are cleaned with the functional liquid L.

In the second filling step, the ink pack 20A and the ink pack 20B are exchanged as shown in FIG. 7C. To be more detailed, the ink pack 20B now filled with the functional liquid L is connected to the first connector 141, and the ink pack 20A that has been cleaned with the functional liquid L is connected to the second connector 142. Then the pressurizing device 150 applies a pressure to the ink pack 20B connected to the first connector 141 to thereby transfer the functional liquid L in the ink pack 20B to the ink pack 20A connected to the second connector 142 through the filter 120 and the second on-off valve 132, thus to again fill the ink pack 20A with the functional liquid L.

With the liquid filling device 100 and the liquid filling method thereby performed according to this embodiment, the ink pack 20A connected to the first connector 141 can be cleaned by using the functional liquid L, through the first filling step and the transfer step. At the same time, the supply path of the functional liquid L (including the supply tube 114) can also be cleaned. Then through the second filling step, in which the ink pack 20B is connected to the first connector 141 and the ink pack 20A that has been cleaned is connected to the second connector 142 located downstream of the filter 120 so as to again fill the ink pack 20A with the functional liquid L, the ink pack 20A can be filled, with the cleanness maintained therein, with the functional liquid L from which foreign matters and air bubbles have been removed.

After the second filling step, foreign matters in the ink pack 20B, if any, are discharged together with the functional liquid L, and therefore the ink pack 20B can also be cleaned with the functional liquid L. Upon connecting the cleaned ink pack 20B again to the second connector 142 located downstream of the filter 120, the ink pack 20B can be filled with the functional liquid L, with the cleanness maintained therein. The ink pack 20B can be refilled with the functional liquid L by connecting a third ink pack 20 to the first connector 141 and filling it with the functional liquid L, and then transferring the functional liquid L in the third ink pack 20 to the ink pack 20B that has been cleaned.

Thus, the ink packs 20A, 20B can be cleaned with the functional liquid L, and filled with the functional liquid L from which foreign matters and air bubbles have been removed, by repeating the filling step and the transfer step of the functional liquid L.

The supply path of the functional liquid L is cleaned through the first session of the first filling step and the transfer step, and therefore the ink pack 20B filled with the functional liquid L for the first time is free from foreign matters. However, the ink pack 20B may contain an ionic impurity, and in case that the ink pack 20B is suspected to be inappropriate for use with the functional liquid L, the ink pack 20B may be disposed of. In the case where the ink pack 20B is decided to be usable the functional liquid L can be refilled therein as described above, and thus the loss of the functional liquid L arising from the filling and transferring thereof can be minimized.

Second Embodiment

Liquid Filling Device

Figure 8:
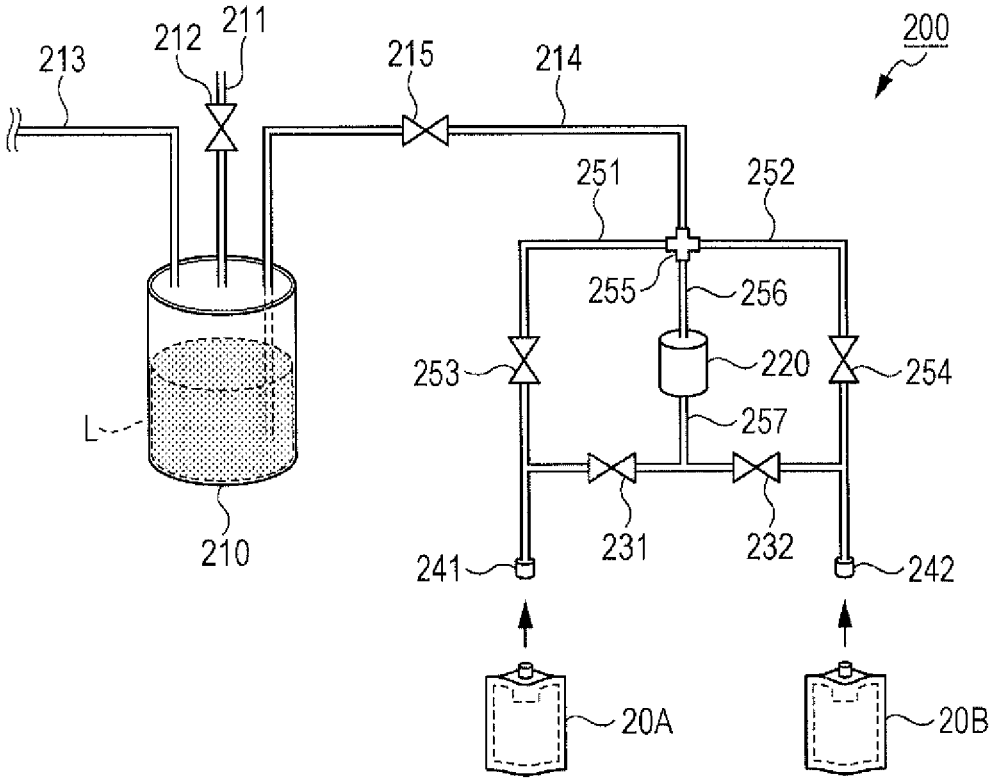
FIG. 8 is a schematic drawing showing a configuration of a liquid filling device according to a second embodiment.

Hereunder, a second embodiment of the liquid filling device will be described referring to FIG. 8. FIG. 8 is a schematic drawing showing a configuration of the liquid filling device according to the second embodiment.

As shown in FIG. 8, the liquid filling device 200 according to this embodiment includes an ink tank 210 to store therein the functional liquid L, a filter 220, and a first connector 241 and a second connector 242 to which a pair of ink packs 20 (20A, 20B) are respectively connected. In addition, the liquid filling device 200 also includes the pressurizing device 150 that applies a pressure to the ink packs 20 connected to the first connector 241 and the second connector 242 as in the first embodiment, though not shown in FIG. 8.

Like the ink tank 110 according to the first embodiment, the ink tank 210 is a sealed tank, and an inlet tube 211 and an inlet valve 212 for the functional liquid L are provided above the ink tank 210. In addition, a gas inlet tube 213 is provided above the ink tank 210 for introducing a gas for pressurizing the inside of the ink tank 210. A supply tube 214, exemplifying the supply path in the invention, is connected to the ink tank 210, and an end portion of the supply tube 114 extends as far as the vicinity of the inner bottom of the ink tank 210. A liquid supply valve 215 that controls the supply of the functional liquid L is provided on the supply tube 214.

The other end portion of the supply tube 214 is connected to a manifold 255. The manifold 255 is configured to accept four tubes. In addition to the supply tube 214, a tube 256 connected to the filter 220, a tube 251 corresponding to the first bypass route in the invention, and a tube 252 corresponding to the second bypass route in the invention are connected to the manifold 255.

A tube 257 is connected to the downstream end of the filter 220, and the first connector 241 and the second connector 242 are connected in parallel to the tube 257. The tube 251 corresponding to the first bypass route, connected to the manifold 255 via an end portion, is connected to the first connector 241 via the other end portion. Likewise, the tube 252 corresponding to the second bypass route, connected to the manifold 255 via an end portion, is connected to the second connector 242 via the other end portion.

A first on-off valve 231 is provided on a tube located between the tube 257 downstream of the filter 220 and the first connector 241. Likewise, a second on-off valve 232 is provided on a tube located between the tube 257 downstream of the filter 220 and the second connector 242. A third on-off valve 253 is provided on the tube 251 between the manifold 255 and the first connector 241. Likewise, a fourth on-off valve 254 is provided on the tube 252 between the manifold 255 and the second connector 242.

In the case where the liquid filling device 200 is configured so as to change the flowing direction of the functional liquid L, a three-way on-off valve having the functions of both the first on-off valve 231 and the second on-off valve 232 may be employed. Likewise, a three-way on-off valve having the functions of both the third on-off valve 253 and the fourth on-off valve 254 may be employed.

The filter 220 is of a capsule type, and capable of removing foreign matters as well as removing air bubbles from the functional liquid L, as in the first embodiment.

The liquid filling device 200 is configured to supply the functional liquid L to the first connector 241, the second connector 242, and the filter 220 through the supply tube 214, by pressurizing the ink tank 210 filled with the functional liquid L with an inert gas such as nitrogen through the gas inlet tube 213.

As stated referring to the first embodiment, the liquid filling device 200 may also include a meter that monitors the amount and density of the functional liquid L in the ink tank 210, a heating device such as a heater for lowering the viscosity of the functional liquid L, a meter that detects the pressure at the front and rear of the filter 220 to thereby monitor the life span of the filter 220 on the basis of the pressure difference (pressure loss), a meter that monitors the size and amount of particles (foreign matters) contained in the functional liquid L, or a degassing module that removes a gas dissolved in the functional liquid L.

Liquid Filling Method

Referring now to FIGS. 9A to 9D, a liquid filling method to be performed by using the liquid filling device 200 will be described hereunder. FIGS. 9A to 9D are schematic drawings for explaining the liquid filling method according to the second embodiment. The ink tank 210 and the pressurizing device 150 are excluded from FIGS. 9A to 9D for the sake of clarity.

The method of filling the ink pack 20, corresponding to the liquid container in the invention, with the functional liquid L by using the liquid filling device 200 according to this embodiment includes a connection step, a first filling step, a transfer step, a second filling step, and a third filling step.

In the connection step, the ink packs 20A and 20B, which are empty at this point, are respectively connected to the first connector 241 and the second connector 242, as in the first embodiment. The ink pack 20A connected to the first connector 241 corresponds to the first liquid container in the invention, and the ink pack 20B connected to the second connector 242 corresponds to the second liquid container in the invention. Here, gas (air) in the empty ink packs 20A, 20B is discharged by pressurizing the liquid bag 21, before these ink packs are connected to the first connector 241 and the second connector 242.

Figure 9A:
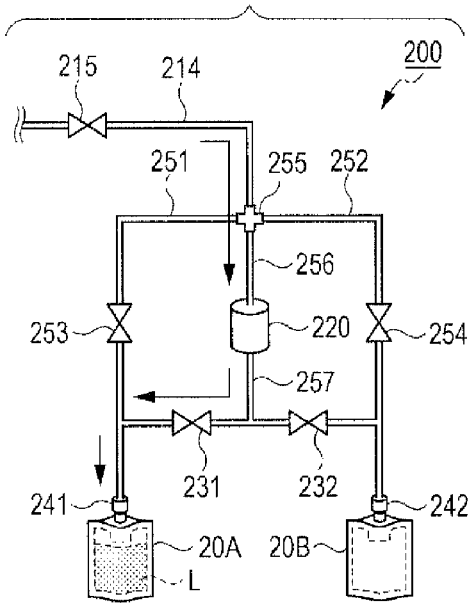
FIGS. 9A to 9D are schematic drawings for explaining a liquid filling method according to the second embodiment.

In the first filling step, the functional liquid L is introduced into the ink pack 20A connected to the first connector 241 through the supply tube 214 and the filter 220 as shown in FIG. 9A, with the liquid supply valve 215 and the first on-off valve 231 opened and the second on-off valve 232, the third on-off valve 253, and the fourth on-off valve 254 closed.

Figure 9B:
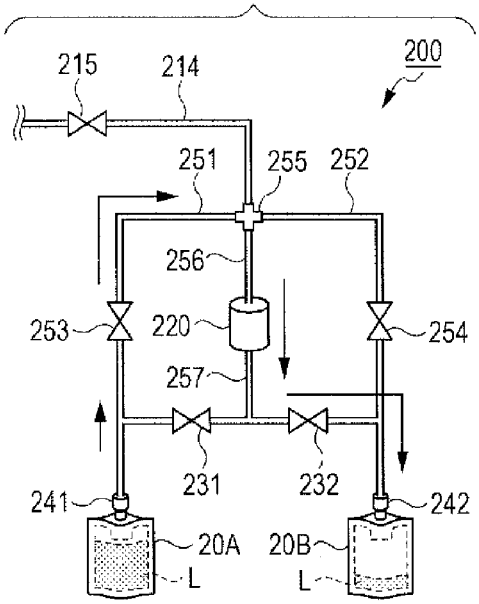
Figure 9C:
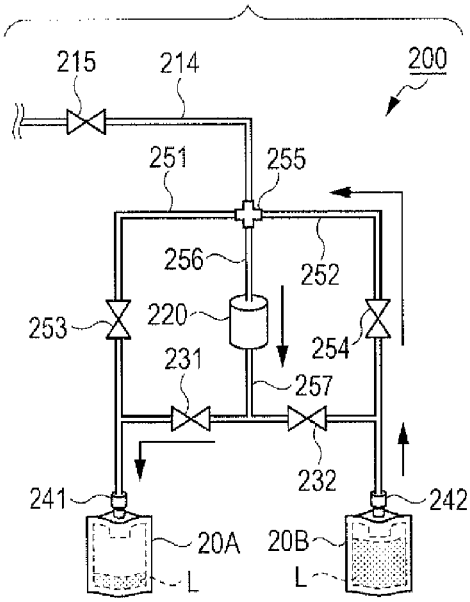

In the transfer step, the liquid supply valve 215, the first on-off valve 231, and the fourth on-off valve 254 are closed, and the second on-off valve 232 and the third on-off valve 253 are opened. Under such setting, the functional liquid L in the ink pack 20A is transferred to the ink pack 20B connected to the second connector 242, through the tube 251 and the filter 220, as shown in FIG. 9B. To transfer the functional liquid L, the pressurizing device 150 applies a pressure to the liquid bag 21 of the ink pack 20A.

Through the first filling step and the transfer step, the ink pack 20A is cleaned with the functional liquid L. At the same time, the supply tube 214, the tubes 251, 256, and 257 are also cleaned with the functional liquid L.

In the second filling step, the pressurizing device 150 applies a pressure to the ink pack 20B connected to the second connector 242, with the first on-off valve 231 and the fourth on-off valve 254 opened and the second on-off valve 232 and the third on-off valve 253 closed, to thereby transfer the functional liquid L in the ink pack 20B to the ink pack 20A connected to the first connector 241 through the tube 252 and the filter 220 as shown in FIG. 9C, thus to again fill the ink pack 20A with the functional liquid L.

Upon performing the second filling step, the ink pack 20B is cleaned with the functional liquid L. At the same time, the tube 252 is also cleaned with the functional liquid L. Further, the ink pack 20A cleaned through the first filling step and the transfer step is again filled with the functional liquid L through the filter 220. Thus, the ink pack 20A in which sufficient cleanness is secured can be filled with the functional liquid L from which foreign matters and air bubbles have been removed.

Figure 9D:
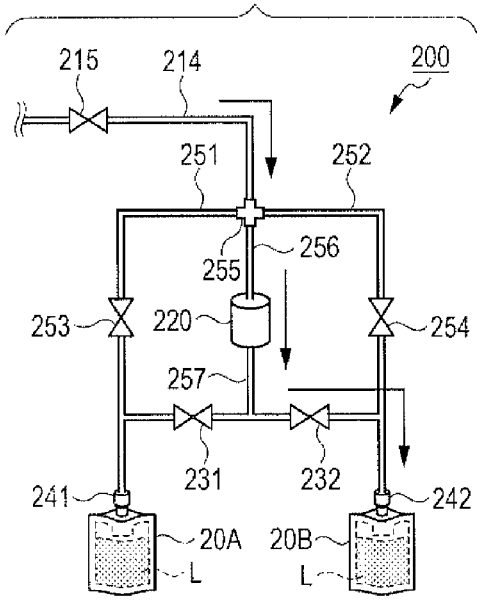

In the third filling step, the liquid supply valve 215 and the second on-off valve 232 are opened and the first on-off valve 231, the third on-off valve 253, and the fourth on-off valve 254 are closed. Under such setting, the ink pack 20B connected to the second connector 242 is filled with the functional liquid L, through the supply tube 214 and the filter 220, as shown in FIG. 9D.

Upon performing the third filling step, the ink pack 20B in which sufficient cleanness is secured can be filled with the functional liquid L from which foreign matters and air bubbles have been removed.

With the liquid filling method to be performed by using the liquid filling device 200 according to the second embodiment, both of the ink packs 20A, 20B can be cleaned by using the functional liquid L, and the ink packs 20A, 20B thus cleaned can be efficiently filled with the with the functional liquid L from which foreign matters and air bubbles have been removed, without the need to remove or exchange the ink packs 20A, 20B respectively connected to the first connector 241 and the second connector 242, halfway of the filling process.

The liquid filling devices 100, 200 according to the first and the second embodiment do not employ a suction unit to discharge the functional liquid L from the ink pack 20, unlike the technique according to JP-A-2005-186343. Therefore, the functional liquid L is exempted from the risk of contamination by the suction unit. In addition, the liquid filling devices 100, 200 have a simpler configuration compared with that of JP-A-2005-186343, and therefore loss of the functional liquid L can be minimized in the filling and transferring process.

It is to be understood that the invention is in no way limited to the foregoing embodiments, but may be modified as desired within the scope and spirit of the invention set forth in the appended claims. Liquid filling methods and liquid filling devices that reflect such modification, as well as liquid containers to which any of the liquid filling methods and liquid filling devices are applied, are included in the technical scope of the invention. To cite a few examples, the foregoing embodiments may be modified as under.

Variation 1

In the liquid filling device 100 according to the first embodiment, two or more filters may be provided in the supply path of the functional liquid L. For example, another filter of a larger mesh size than the filter 120 may be provided in the supply tube 114 serving as the supply path. In this case, foreign matters can be removed in stages according to the size thereof, and therefore the life span of the filter 120 can be prolonged. Such a configuration of the filter is also applicable to the liquid filling device 200 according to the second embodiment.

Variation 2

In the liquid filling device 200 according to the second embodiment, three or more ink packs 20 may be provided to be filled with the functional liquid L. For example, in the case where one or more additional connectors are connected in parallel to the supply tube 214 in addition to the first connector 241 and the second connector 242, three or more ink packs 20 can be connected for more efficient filling of the functional liquid L.

Variation 3

The functional liquid L to be filled in the ink pack 20, corresponding to the liquid container in the invention, is not limited to the one employed for forming a functional layer of an organic EL element through a liquid-phase process. The functional liquid L may be a chemical for medical use. In the case of filling the ink pack 20 with a chemical liquid for medical use by using the liquid filling device 100 or 200, it is preferable that the liquid filling device 100 or 200 include a sterilizer such as a UV irradiator that kills microorganisms contained in the liquid.

The entire disclosure of Japanese Patent Application No. 2013-038465, filed Feb. 28, 2013 is expressly incorporated by reference herein.

What is claimed is:

1. A liquid filling device that fills a sealable liquid container with a liquid, the liquid filling device comprising:

a supply path of the liquid;

a filter connected to the supply path and at least capable of removing a foreign matter;

a first provided between the supply path and the filter;

a first connector provided between the first valve and the filter;

a second valve provided between the first connector and the filter, or downstream of the filter;

a second connector provided downstream of the filter via the second valve therebetween; and a first liquid container and a second liquid container respectively connected to the first connector and the second connector, wherein the first liquid container connected to the first connector is filled with the liquid through the supply path and the first valve, and the liquid thus filled is transferred to the second liquid container connected to the second connector through the second valve and the filter.

2. The liquid filling device according to claim 1, wherein, after the liquid is transferred, the first liquid container is disconnected from the first connector and is connected to the second connector, the second liquid container is disconnected from the second connector, and is connected to the first connector, and the liquid is transferred from the second liquid container to the first liquid container, through the filter.

3. A liquid filling device that fills a sealable liquid container with a liquid, the liquid filling device comprising:

a supply path of the liquid;

a filter connected to the supply path and at least capable of removing a foreign matter;

a first valve provided downstream of the filter;

a first connector connected to the first valve;

a second valve provided downstream of the filter parallel to the first valve; a second connector connected to the second valve;

a first bypass route provided between the supply path upstream of the filter and the first connector; a third valve provided on the first bypass route;

a second bypass route provided between the supply path upstream of the filter and the second connector;

a fourth valve provided on the second bypass route, and a first liquid container and a second liquid container respectively connected to the first connector and the second connector, wherein the liquid is filled in the first liquid container connected to the first connector through the supply path, the filter, and the first valve, with the second valve, the third valve, and the fourth valve closed; the first valve is closed and the liquid filled in the first liquid container is transferred to the second liquid container connected to the second connector through the first bypass route, the filter, and the second valve; and the second valve is closed and the liquid transferred to the second liquid container is again transferred to the first liquid container connected to the first container through the second bypass route, the filter, and the first valve.

4. The liquid filling device according to claim 3, wherein, after the liquid is again transferred to the first liquid container connected to the first connector, the first valve, the third valve, and the fourth valve are closed and the second valve is opened, so as to again fill the second liquid container connected to the second connector through the supply path and the filter.

5. The liquid filling device according to claim 1, wherein the liquid container includes:

a flexible liquid bag for storing the liquid therein; and a communication port that secures communication between inside and outside of the liquid bag, and the liquid filling device further comprises a pressurizing device that applies a pressure to the liquid bag from outside so as to discharge the liquid from the liquid bag through the communication port.

6. The liquid filling device according to claim 1, wherein the filter is configured so as to discharge an air bubble in the liquid.

7. The liquid filling device according to claim 1 further comprising a liquid container configured to be filled with the liquid by the liquid filling device.

8. The liquid filling device according to claim 2 further comprising a liquid container configured to be filled with the liquid by the liquid filling device.

9. The liquid filling device according to claim 3 further comprising a liquid container configured to be filled with the liquid by the liquid filling device.

10. The liquid filling device according to claim 4 further comprising a liquid container configured to be filled with the liquid by the liquid filling device.

11. The liquid filling device according to claim 5 further comprising a liquid container configured to be filled with the liquid by the liquid filling device.

12. The liquid filling device according to claim 6 further comprising a liquid container configured to be filled with the liquid by the liquid filling device.

* * * * *